US005205631A

United States Patent [19]

Wegman et al.

[11] Patent Number: 5,205,631

[45] Date of Patent: Apr. 27, 1993

[54] PLATFORM STRUCTURE FOR DRAWERS AND WORKING SURFACES

[75] Inventors: Thomas Wegman; John N. Lechman, both of Effingham, Ill.

[73] Assignee: Nova Manufacturing & Assembly, Inc., Effingham, Ill.

[21] Appl. No.: 774,416

[22] Filed: Oct. 10, 1991

[51] Int. Cl.[5] ..... A47B 88/00

[52] U.S. Cl. ..... 312/348.3; 312/208.1; 312/902

[58] Field of Search ..... 312/348.3, 330.1, 208.1, 312/208.2, 208.3, 208.4, 208.5, 208.6, 209, 211, 902; 248/205.3

[56] References Cited

U.S. PATENT DOCUMENTS

| | | | |
|---|---|---|---|
| 213,814 | 4/1879 | Emanuel | 312/348.3 |
| 764,832 | 7/1904 | Valentine | 312/330.1 |
| 774,879 | 11/1904 | Hullhorst | 312/209 |
| 804,089 | 11/1905 | Blanc et al. | 312/208.1 |
| 895,640 | 8/1908 | Hullhorst | 312/209 |
| 1,398,237 | 11/1921 | Michaels | 312/208.1 |
| 2,242,745 | 5/1941 | Coxhead | 312/208.1 |
| 2,511,919 | 6/1950 | Jones et al. | 312/208.1 |
| 2,588,844 | 3/1952 | Jones et al. | 312/208.1 |
| 2,893,533 | 7/1959 | Childs | 312/208.1 |
| 3,295,474 | 4/1967 | Ornstein | 248/205.3 |
| 4,562,482 | 12/1985 | Brown | 312/209 |
| 4,709,972 | 12/1987 | La Budde et al. | 312/208.3 |
| 4,782,619 | 11/1988 | Richards | 312/209 |
| 5,036,975 | 8/1991 | Chow | 312/902 |

*Primary Examiner*—Victor N. Sakran
*Attorney, Agent, or Firm*—Olson & Hierl

[57] ABSTRACT

A platform structure is provided that is suitable for incorporation into a drawer, a slidable tray, a storage pedestal, or the like. The platform structure comprises a formed thermoplastic sheet member which has desired compartments defined therein, and an underlying frame structure, preferably wood or a wood-containing material. Contacting surfaces are bonded together with an adhesive. Rails can be mounted along opposite side walls for slide purposes, as in a drawer or tray assembly. Alternatively, rear facial portions of the frame structure can be connected to the top of a storage pedestal or the like.

12 Claims, 2 Drawing Sheets

PLATFORM STRUCTURE FOR DRAWERS AND WORKING SURFACES

FIELD OF THE INVENTION

This invention relates to platform structures having compartmentalized working surfaces and adapted for use in drawers, as slidable support trays and in storage pedestals, such as are employed in desks, cabinets and the like.

BACKGROUND OF THE INVENTION

The widespread usage of desk or table positioned computerized word processing equipment in office and residential settings has created a substantial need for drawers, slidable trays, and the like which have decks or platforms with compartments or recesses defined in interior top working surface portions. Such compartments are needed for easily accessible, organized storage of not only conventional office supplies, such as pencils, paper clips, rubber bands, paper and the like, but also word processing supplies, such as discs, a mouse, a keyboard and similar components.

To make a compartmentalized tray structure of wood involves substantial labor and material costs, while to make such a structure of a molded thermoplastic involves substantial material costs and expensive, relatively large plastic molding machinery. Forming such a structure from a relatively thin sheet of thermoformable plastic or of stampable metal appears to be economically feasible, but the resulting formed sheet typically lacks sufficient structural rigidity, thereby making it unstable and difficult to fasten to other components, such as walls members, slide rails and the like. Further, stamping machines for metal sheeting are expensive, particularly with regard to dies, and the potential shapes that can be produced are limited.

There is a need for a compartmentalized structure which is sufficiently rigid for practical use and which is combinable as a subassembly with other selected components to comprise a drawer assembly, a slidable tray assembly, a storage pedestal assembly, or the like. The present invention satisfies this need.

SUMMARY OF THE INVENTION

The present invention provides an improved platform structure adapted for incorporation as a subassembly into a drawer, a slidable support tray, a storage pedestal or the like, such as can be incorporated into desks, cabinets, and the like.

Such a platform structure can contain one or more compartments or compartmentalized regions in its tray portions. Such a platform structure also has structural rigidity even though it utilizes a formed, relatively thin sheet of plastic.

The platform structure can be readily fastened to other components using conventional fastening means, thereby incorporating the platform structure into an assembly to comprise a drawer structure, a slidable support tray, a storage pedestal or the like, as desired.

The structure is relatively like weight, yet is strong, stable and durable, and is readily cleanable. The structure is also relatively easy and economical to fabricate, yet has a long life and requires virtually no routine maintenance.

Platform structures of this invention comprise a preformed, generally self supporting but relatively thin sheet member preferably comprised of a thermoformable plastic, composite, laminate, or the like which is overlaid upon, and which is adhesively bonded preferably in at least the perimeter regions thereof to a generally underlying, preformed flattened frame structure which can be variously comprised of a material such as wood or a wood-containing product, plastic, low density metal or metal alloy, mixtures thereof, or the like.

Such a formed sheet member in an assembled platform structure has a non-planar, compartmentalized configuration in its main platform or upper working surface portions. For example, the configuration can be in the form of a single flattened central region surrounded by a peripheral rib-like region that is elevated relative thereto. Another configuration can be in the form of a plurality of variously sized dished receptacles which are separated from one another by upstanding rib-like regions that are elevated relative to bottom portions of such receptacles.

Platform structures of this invention provide configurations which are not readily or simply achievable with only conventional wood or wood-containing components yet are readily suitable for incorporation into assemblies, such as drawers, slidable trays, storage pedestals, cabinets, and the like.

Also, platform structures of this invention in the foregoing assemblies provide stability, and also provide a solid surface. The structures can be easily fabricated and cooperatively associated with other components to comprise such assemblies. Thus, tray structures of this invention provide a combination of features which is not readily or simply achievable with only relatively thin plastic or metal sheeting.

For example, the present invention provides a slidable keyboard tray assembly or a compartmentalized drawer assembly wherein opposite sides of an appropriate support platform-structure are associated with slide rail, or similar support means.

For another example, the present invention provides a top assembly that can be joined peripherally to end and side wall structural components to comprise a storage pedestal.

Advantageously, platform structures of this invention are conveniently fabricated by using various conventional techniques.

Other and further objects, purposes, features, advantages, embodiments, and the like will be apparent to those skilled in the art from the present specification taken with associated the drawings and the appended claims.

DETAILED DESCRIPTION

Figure 1:
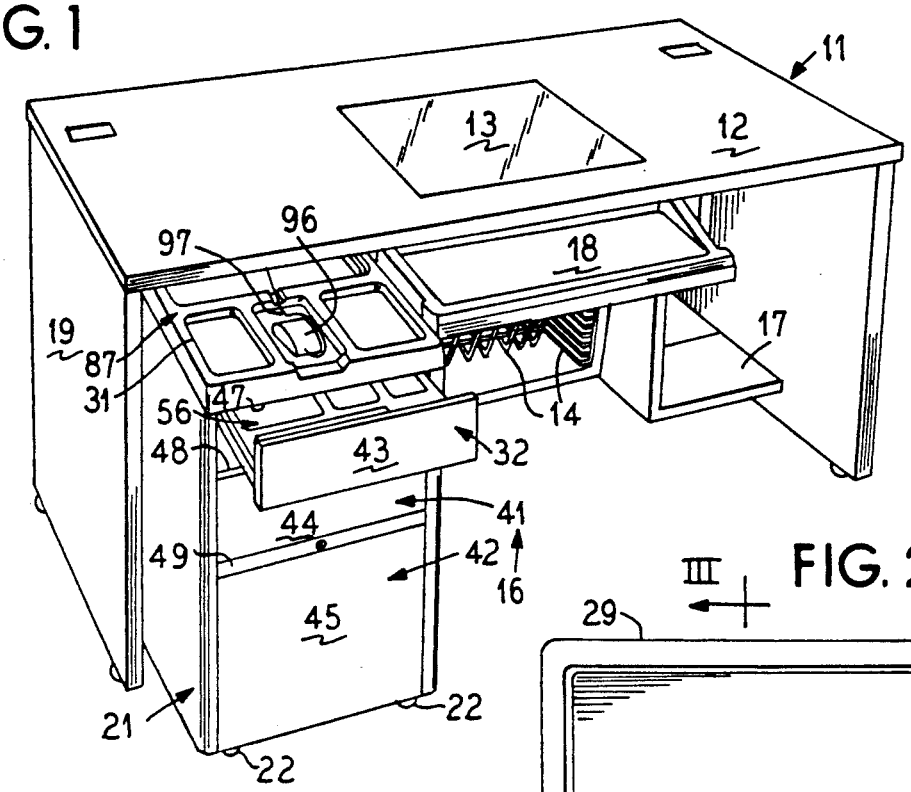
FIG. 1 is a perspective view of one embodiment of a desk which incorporates three different embodiments of platform structures of this invention, one embodiment being a slidable computer keyboard tray, a second embodiment thereof being a drawer and a third embodiment being a storage pedestal.

Referring to FIG. 1 of the drawings, there is seen an embodiment of a desk structure 11 which has a flattened top member 12 provided in a central portion thereof with an inset window 13. Supportable on a rack 14 mounted in the knee cavity 16 of the desk 11 below a window 13 is a computer monitor (not shown) for a word processing system, or the like, whose computer (not shown) is housed in the desk 11 on a shelf 17.

To operate the word processor, a keyboard (not shown) is positioned on a slidable extensible and retractable (relative to desk 11) tray 18 which is located beneath the top member 12 adjacent the window 13 over the knee cavity 16. Thus, an operator can sit at desk structure 11 (chair not shown) and operate the keyboard while observing the monitor through the window 13.

Under the top member 12 and between the knee cavity 16 and the left side 19 (as seen in FIG. 1) of desk 11 is located a floor-engaging, caster-supported, rollable storage pedestal assembly 21. The storage pedestal 21 is conveniently mounted on four casters 22 (not detailed) so that the pedestal assembly 21 as a unit is slidable extensible and retractable out of and into the desk structure 11 under top member 12. Storage pedestal 21 employs opposed side walls and a back wall. The front thereof (and the internal structure thereof) are conventionally adapted to accommodate slidable drawers.

Figure 2:
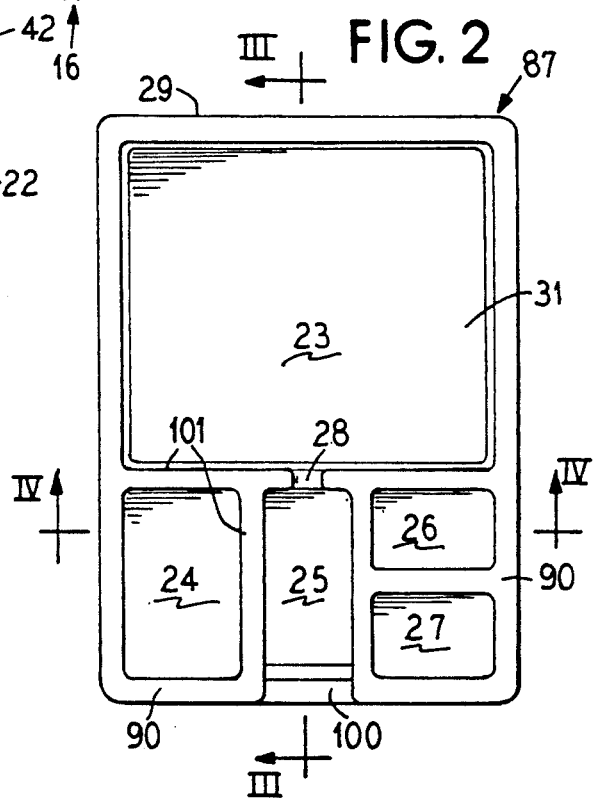
FIG. 2 is a plan view of the storage pedestal shown in FIG. 1.
Figure 3:
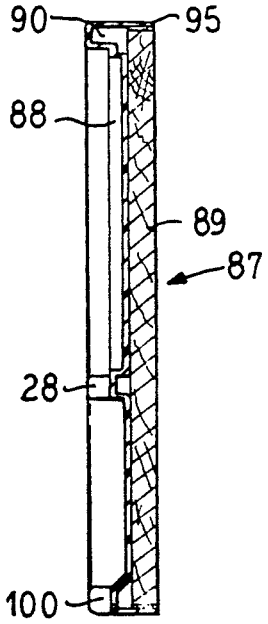
FIG. 3 is a vertical longitudinal sectional view taken front to back along the line III—III of FIG. 2.
Figure 4:
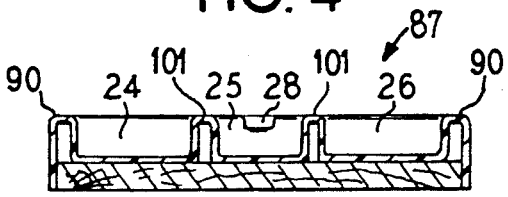
FIG. 4 as is vertical transverse sectional view taken along the line IV—IV of FIG. 2.

Referring to FIGS. 2–4, the pedestal assembly 21 is seen to have a top deck structure 87 whose surface 31 is provided with a plurality of recesses formed therein which recesses are identified by the respective numerals 23 through 27 as shown in FIG. 2. The front and central recess 25 is adapted to receive a mouse 96. As those skilled in the art will appreciate, a mouse is a device that is functionally interconnected with a word processor or the like and whose movements on a flat surface correspond to cursor movements on a visual display unit or monitor a mouse device can either obviate the need for a keyboard or can be used in cooperation with the keyboard. When in use, the mouse 96 can be lifted by an operator from recess 25 and moved to the top member 12, if desired. The electrical wire member 97 that is associated with the mouse 96 is moved and drawn along with the mouse 96 during operation. For easy slidability of the wire member 97, a crevice 28 is further provided in the rib-like back wall of recess 25 so that the wire member 97 can easily slide from and over the back edge 29 of top surface 31 and through crevice 28 during use of the mouse 96.

Figure 5:
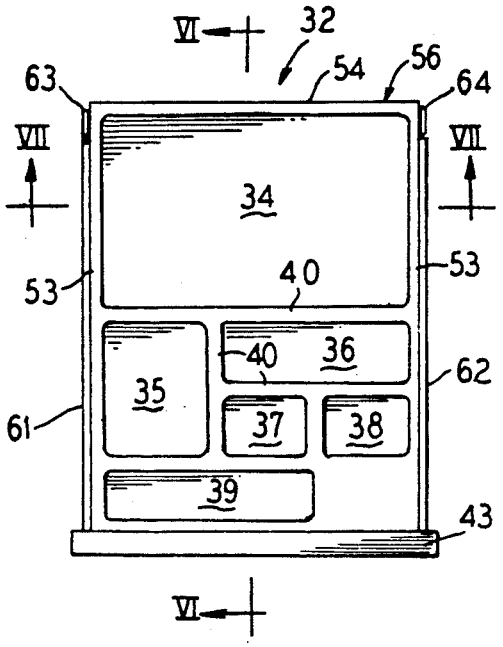
FIG. 5 is a plan view of a drawer in the storage pedestal shown in FIG. 1.

Beneath the top surface 31, the pedestal assembly 21 is provided with a drawer 32 which is slidably extendable and retractable out of and into the front side of the pedestal assembly. The drawer 32 has a platform structure 56 which is provided with a plurality of recesses formed therein that are individually identified by the respective numerals 34 through 39 as shown in FIG. 5. These recesses can serve various storage purposes, as the operator of the word processing system may choose.

The pedestal assembly 21 is also provided with two additional drawers 41 and 42. Drawers 41 and 42 are here conventional (and not detailed). Each of drawers 32, 41, and 42 is opened by finger insertion into respective slots 47, 48 and 49 overlying the respective drawer fronts 43, 44 and 45. In place of drawers 32, 41 and 42, a pedestal assembly 21 equipped with platform structure 87 can have shelves or other storage means, as desired.

The slidable computer keyboard tray 18, the slidable drawer 32, and the storage pedestal assembly 21 that is provided with top surface structure 31 each comprise a different inventive assembly which incorporates a platform structure of this invention.

Figure 6:
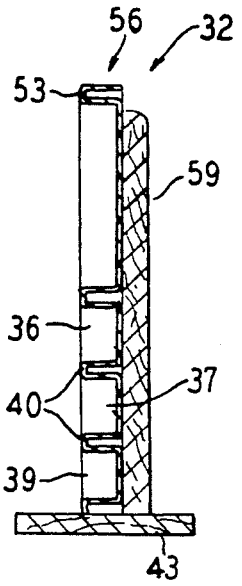
FIG. 6 is a vertical longitudinal sectional view taken front to back along the line VI—VI of FIG. 5.
Figure 7:
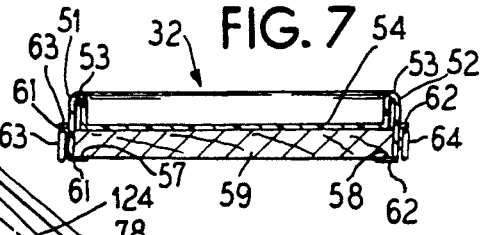
FIG. 7 is a vertical transverse sectional view taken along the line VII—VII of FIG. 5.

Referring to FIGS. 5–7, the drawer 32 and its incorporated platform structure 56 are shown. Drawer 32 utilizes a sheet member 54 which is formed to have defined in the platform area or structure 56 therein the indicated recesses or compartments 34–39. Between and adjacent such recesses are upstanding interior rib-like members that are generally identified by the numeral 40. Opposed side perimeter portions 51 and 52 (see FIG. 7) of sheet 54 are downturned from a peripheral upsranding rib portion 53 that is formed in sheet 54 and that extends generally about the outside edge portions of the platform structure 56. The side portions 51 and 52 each terminate in edge portions 57 and 58, respectively, that are generally in a spaced, parallel coplanar relationship to one another.

Platform structure 56 incorporates an underlying supporting frame structure 59 which has a generally flattened configuration. Component portions of frame structure 59 extend generally continuously about the perimeter thereof. In general, the interrelationship between the formed sheet member 54 and the frame structure 59 in platform structure 56 is such that the perimeter dimensions of the sheet number 54 are slightly greater than, or are equal to, the perimeter dimensions of the frame structure 59 so that the frame structure 59 is receivable within the back side of the formed sheet 54. Also, the depths of each of the recesses 34–39 are preferably equal, and each of the recesses has a backside facial portion that abuts against adjacent underlying portions of the frame structure 59.

A layer (not shown) of an adhesive means is employed to adhere at least some abutting portions of the formed sheet member 54 to the frame structure 59. The adherence is achieved preferably in at least the perimeter regions of the frame structure 59 and the sheet member 54, but more preferably at all abutting locations between sheet member 54 and frame structure 59.

In drawer 32, rail members 61 and 62 of formed sheet metal or the like are extended along respective opposing side perimeter portions 51 and 52 in spaced parallel relationship to one another. Each rail member 61 and 62 is conventional in structure has a generally Z-shaped cross sectional profile and includes at its internal end a roller or rotatable wheel member 63 and 64, respectively. Each rail member 61 and 62 is preferably adjustably mounted to the sides 51 and 52 of the platform structure 56 by screw means or the like (not shown) which extend through sheet member 54 into the frame structure 59. Alternatively, rivet means (not shown) can mount each rail member to the adjacent portions 51 and 52 of sheet member 54 before the formed sheet member 54 is adhesively bonded to the frame structure 59. Any convenient such fastening means may be used.

The front edge portion of platform structure 56 has mounted thereacross a conventional drawer front 43. Preferably, the drawer front 43 is directly joined to the adjacent front edge portions of frame assembly 59 by an adhesive, screw means or a combination thereof. To achieve a close engagement between the platform assembly 56 and the drawer front 43, the sheet member 54 is formed so that the top of rib 53 terminates in an edge which abuts against the back face of drawer front 43. However, the back edge of sheet member 54 is turned down at the rear of platform assembly 56.

Figure 8:
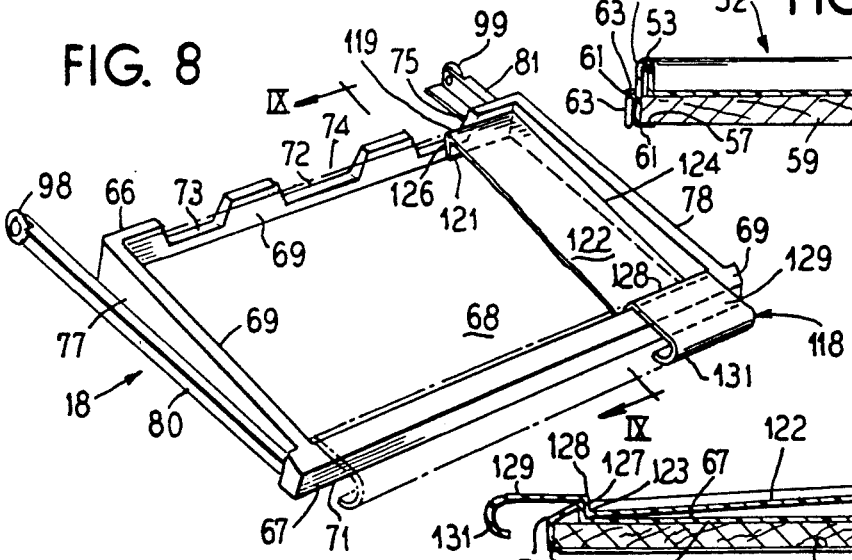
FIG. 8 is a perspective view of the keyboard tray shown in FIG. 1 such tray being additionally provided with an optional nestably received tray insert member (shown fragmentarily)
Figure 9:
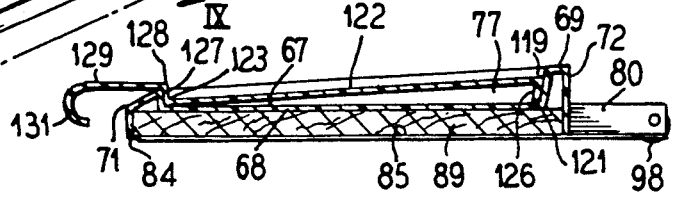
FIG. 9 is a vertical longitudinal sectional view taken front to back along the line IX—IX in FIG. 8.
Figure 10:
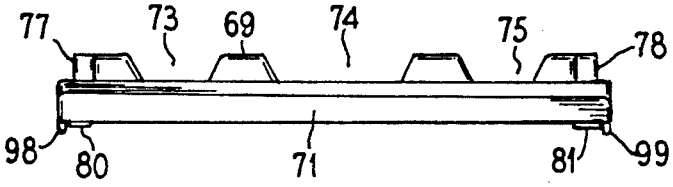
FIG. 10 is a front elevational view of the keyboard tray shown in FIG. 8.

Referring to FIGS. 8–10, there is detailed the keyboard tray 18 and its incorporated platform structure 66. A sheet member 67 is formed so as to have in its platform area a single central recess 68 that has a perimeter defined by a continuously extending peripheral raised rib-like projection 69. In the embodiment shown, the elevation of the rib-like projection 69 rises as one proceeds from the front side 71 of the deck structure 58 to the back side 72, yet, in the tray assembly 18, the recess 68 remains approximately horizontal when the tray 18 is mounted in desk 11.

For purposes of easy access to the recess 68 from the back side 72 of tray 18 for wires (not shown) associating a keyboard positioned in tray recess 68 with word processing apparatus, the back side 72 in the rib-like projection 69 is provided with notch-like, open-topped apertures 73, 74 and 75.

Opposite sides 77 and 78 of platform structure 66 are provided with conventional rail members 80 and 81, respectively, which can be similar in structure and function to rail members 61 and 62, and which are provided with roller wheels 98 and 99, respectively.

In the platform structure 66 shown, the rib-like projection 69 is preferably thickened along the front side 71 and also is downwardly and outwardly beveled as a wrist rest in view of the intended usage of tray assembly 18 as a keyboard tray.

Also, in platform structure 66, the formed sheet member 67 additionally includes both front side and back side downturned perimeter projections 71 and 72 along with downturned opposing side portions on sides 77 and 78, all of which terminate in edge portions 84 that are generally coplanar to the back side edge portions 85 of the frame structure 89. Like frame structure 59, frame structure 89 is flattened and extends around the bottom perimeter of the platform assembly 66. Abutting areas between frame structure 89 and sheet member 67 are bonded together preferably uniformly by means of adhesive or the like.

Optionally, the keyboard tray I8 is equipped with an insertable, self-supporting, contoured tray insert member 118 which is configured to be nestably received over the upper exposed working surface portions of central recess 68 and rib-like projection 69. The contoured tray member 118 is conveniently and preferably comprised of a sheet of thermoformed plastic whose composition may be, if desired, similar to the composition of sheet member 67. The function of contoured tray members 118 is to provide a simple and reliable means for adjusting or varying the contours associated with upper exposed working surface portions of central recess 68 and rib-like projection 69, thereby to provide the user with options.

The back edge 119 of insertable tray member 118 at the terminus of the main central flat surface 122 thereof is provided with a downturned, integrally formed flange portion 126 which has a rear terminal edge 121 that is adapted to rest against the rear terminal edge of the central recess 68 in tray 18. The forward edge 123 (see FIG. 9) of central flat surface 122 of insertable tray member 118 (located along the frontal commencement of the main central flat surface 122) is configured to rest against the forward edge of the central recess 68 of tray 18. Opposite side edges 124 (see FIG. 8) of insertable tray member 118 are adapted to be nestably received within, but adjacent to, opposite sides 77 and 78 of tray 18.

Thus, central flat surface 122 is angularly inclined, or tilted upwards and forwardly, in a stable configuration relative to the flat central surfaces of recess 68, as desired, relative to a worker seated at desk 11. The pitch of flat surface 122 is preferably chosen so that a given keyboard structure (not shown) can be set upon flat surface 122 in an operative orientation without impairing the capacity of the tray 18 to be slidably extended and retracted as described under the desk top member 12 (see FIG. 1), as those skilled in the art will appreciate. The vertical width of the flange portion 126 can be selected so as to produce a desired pitch for flat surface 122 that is between horizontal (like that for the surface of central recess 18) and the maximum pitch possible consistent with slidability for tray 18. Of course, if the tray 18 does not need to be slidable with the insertable contoured tray member 118 in position, then higher pitches can be selected as desired.

Integrally formed with the forward edge 123 is an initially upturned and then outturned flange portion 127 which is configured to rest against the inside (relative to central reces 68) adjacent portions of the front side 71 of tray 18. The flange portion 127 thus prevents the insertable tray 118 from sliding forward.

Integrally formed with the terminal upper edge 128 of upturned flange portion 127 is a forwardly extending shelf-like projection or leaf 129. Leaf 129 at its forward edge region 131 is U-configured along the length thereof. Thus, when insertable tray member 118 is positioned nestably over tray 18, the leaf 129 provides a flattened surface region extending towards the user from a keyboard positioned upon flat inclined surface 122, thereby to provide a wrist rest, as desired. The width of leaf 129 and the curvature of edge region 31 can be varied, as can the inclination of the flattened surface portions of leaf 129.

The inclined surface 122 is thus available, if desired, to eliminate or reduce neck and shoulder strain by permitting the setting of a keyboard at an angle.

The wrist rest provided by leaf 129 is thus available, if desired, to help reduce the occurrence of wrist fatigue and carpal tunnel syndrome.

Referring again to FIGS. 2–4, and the pedestal structure 21 and its incorporated deck structure 87, it is seen that a formed sheet member 88 is utilized which defines surface 31 and which is adhered at least peripherally to a frame structure 89 with an adhesive. The outside perimeter portions of sheet member 88 are downturned equally along all sides. Terminal edge portions 95 of sheet member 88 are generally in coplanar relationship with one another. Back side faces of the sheet member 88 adjacent to edges 95 are adhered to the adjacent portions of the frame structure 89.

An upstanding peripheral rib portion 90 extends to a uniform height peripherally around the platform region of sheet member 88 except in portions thereof adjacent to the mouse recess 25 where the rib portion is optionally but preferably depressed to provided a notch 100. Internal upstanding ribs 101 also formed in sheet member 88 are of equal height in relation to peripheral rib 90 except for crevice 28.

The rear face of frame structure 89 along opposite side edge portions and also along front and rear edge portions is attached by any convenient means (adhesive, screws, a combination thereof or the like) to respective opposed upper edges of the side walls and the back wall of the storage pedestal assembly 21. Thus, the deck structure 87 comprises the top surface of pedestal assembly 21.

A formed sheet member, such as a sheet member 54, 67 or 88, is preferably comprised of a starting relatively rigid plastic sheet member that has been thermoformed conventionally, such as a starting sheet member comprised of, for example, an ABS resin, a high impact polystyrene, an acrylic resin, a polyolefin, a mixed resin blend, or the like, as desired. Conveniently, the starting sheet thickness is in the range of about 0.5 to about 3 millimeters although thicker and thinner thermoformable sheet members can be employed, if desired. A present preference is to employ a sheet member which has a somewhat roughened or mottled surface for use as the exposed surface in a deck structure of this invention since such a finish is believed to offer better surface characteristics for a compartmentalized working surface. Thermoforming is preferably carried out using conventional procedures and equipment to achieve a formed sheet having a desired configuration. After thermoforming, the formed sheet member can be edge trimmed.

A frame structure, such as a frame structure 59, 85 or 89, is conveniently preferably comprised of a single flat piece or board of wood, plywood, particle board (presently most preferred), or like structure containing wood or wood-derived materials. Conveniently, a starting board for such a frame structure can have a thickness in the range of about 0.7 to about 2.5 centimeters (cm) although thicker and thinner relatively rigid sheet members can be employed, if desired. One convenient thickness for particle board is about 1.6 cm. Preferably, such a starting sheet can be shaped by cutting with a conventional saw or the like into a desired perimeter configuration for use in an assembly of his invention.

After the sheet member is formed by thermoforming, it is conveniently laid over the suitably shaped frame structure. The contacting surface portions between the formed sheet member and the formed frame structure are bound to one another by means of an adhesive layer preferably applied to all abutting surfaces therebetween.

Any conventional adhesive can be used, but it is presently preferred to employ a double-faced tape (that is, a tape which has an initially tacky adhesive coated on both opposed faces thereof), such as a tape wherein the adhesive coatings crosslink after application. For example, suitable such double-faced tapes are available from the 3M Company of St. Paul, Minn. If desired, the assembly of the frame structure, the formed sheet and the applied adhesive can be clamped together during a bonding and adhesive crosslinking step using elevated temperatures which are below the temperature softening point of the formed sheet.

Various other and further embodiments, applications, structures and the like will be apparent to those skilled in the art from the teachings herein provided and no undue limitations should be drawn therefrom.

What is claimed is:

1. A platform assembly for incorporation into a drawer or the like comprising in combination:

a) a formed sheet member defining a platform with a front face, an opposed back face and opposing sides, and having at least one reess defined in said front face, said platform and said recess(es) each having respective perimeters defined by upstanding rib-like proejctions in said front face, and said rib-like projections being downturned along portions of said opposing sides to define peripheral wall portions extending downwardly to locations below said platform perimeter;

b) a frame means defining support for said platform and having a rear face, an opposed forward face, and peripheral opposed edge portions, and further having a generally flattened configuration, said forward face being in abutting engagement with areas of said back face that are generally opposite said recess(es), and at least some area of said edge portions being in abutting engagement with back face areas of said peripheral wall portions; and c) adhesive means bonding together at least some of said areas of abutting engagement.

2. The platform structure of claim 1 wherein slide rail maens additionally extends along each opposing side peripheral wall portion of said platform in spaced, parallel relationship, and including fastening means for mounting said slide rail means adjacent for said opposing sides.

3. The platform structure of claim 2 wherein said fastening means comprises screw means which extends through said rail means and said sheet member into said frame structure.

4. The platform structure of claim 2 wherein said fastening means comprises rivet means that extends through said rail means and said sheet member.

5. The platform structure of claim 2 wherein said sheet member includes a plurality of said recesses, and wherein a drawer front is mounted perpendicularly against said front face of said platform, and including mounting means therefor, so as to comprise a drawer assembly.

6. The platform structure of claim 2 wherein said sheet member includes a single central recess defined in said front face and said recess has a perimeter defined by a continuously extending peripheral raised rib-like projection, and said projection along said back face includes notch-like, open topped apertures, and said sheet member additionally includes front side and back side downturned perimeter portions which terminate in lower edge portions that are generally lateraly coplanar relative to said frame peripheral edge portions, and between which said platform structure extends so as to comprise a keyboard tray.

7. The platform structure of claim 1 wherein at least portions of said rear face are secured to mating top edge portions of the walls of a storage pedestal, including securing means therefor, whereby said platform structure comprises the top surface of said storage pedestal.

8. A keyboard tray for a desk or the like comprising:

a) a formed sheet member defining a platform with a front face, an opposed back face and opposing sides, and having at least one recess defined in said front face, said platform and said recess(es) each having respective perimeters defined by upstanding rib-like projectins in said front face, and said rib-like projections being downturned along portions of said opposing sides to define peripheral wall portions extending downardly to locations below said platform perimeter;

b) a frame means defining support for said platform and having a rear face, an opposed forward face, and periheral opposed edge portions, and further having a generally flattened configuration, said forward face being in abutting engagement with areas of said back face that are generally opposite said recess(es), and at least some area of said edge portions being in abutting engagement with back face areas of said peripheral wall portions; and c) adhesive means bonding together at least some of said areas of abutting engagement; and d) slide rail means extending along each opposing side of said platform, including fastening meawns therefor.

9. The keyboard tray of claim 8 wherein the front edge of said platform perimeter is thickened so as to provide a wrist rest.

10. A drawer for a desk or the like comprising:

a) a formed sheet member defining a platform with a front face, an opposed back face and opposing sides, and having at least one recess defined in said front face, said platform and said recess(es) each having respective perimeters defined by upstanding rib-like projections in said front face, and said rib-like projections being downturned along portions of said opposing sides to define peripheral wall portions extending downwardly to locations below said platform perimeter;

b) a frame means defining support for said platform and having a rear face, an opposed forward face, and peripheral opposed edge portions, and further having a generally flattened configuration, said forward face being in abutting engagement with areas of said back face that are generally opposite said recess(es), and at least some area of said edge portions being in abutting engagement with back face areas of said peripheral wall portions; and c) adhesive means bonding together at least some of said areas of abutting engagement;

d) slide rail means extending along each opposing side of said platform, including fastening means therefor; and e) a drawer front member mounted perpendicularly across the front of said frame means.

11. The drawer of claim 10 wherein asid platform includes a plurality of said recesses.

12. In a storage pedestal of the type having opposing side walls, a back wall, and a front side and interior adapted for storage members, and having means for supporting said pedestal for horizontal sliding movements of said pedestal in response to transversely applied force, the improvement which comprises associating the top of said pedestal with a platform assembly, including association means therefor, said platform assembly comprising:

a) a formed sheet member defining a platform with a front face, an opposed back face and opposing sides, and having at least one recess defined in said front fact, asid platform and said recess(es) each having respective perimeters defined by upstanding rib-like projections in said front face, and said rib-like projections being downturned along portions of said opposing sides to define peripherl wall portions extneding downwardly to locations below said platofrm perimeter;

b) a frame means defining support for said platform and having a rear face, an opposed forward face, and peripheral opposed edge portions, and further having a generally flattened configuration, said forward face being in abutting engagement with areas of said back face that are generally opposite said recess(es), and at least some area of said edge portions being in abutting engagement with back face areas of said peripheral wall portions; and c) adhesive means bonding together at least some of said areas of abutting engagement.

* * * * *